US009249964B2

(12) United States Patent
Hansen et al.

(10) Patent No.: US 9,249,964 B2
(45) Date of Patent: Feb. 2, 2016

(54) MULTI-PURPOSE ILLUMINATION DEVICE

(71) Applicant: Zweibrüder Optoelectronics GmbH & Co. KG, Solingen (DE)

(72) Inventors: Sven Hansen, Guangdong Province (CN); Andre Kunzendorf, Solingen (DE); Tobias Schleder, Portland, OR (US)

(73) Assignee: Zweibruder Optoelectronics GmbH & Co. KG, Solingen (DE)

( * ) Notice: Subject to any disclaimer, the term of this patent is extended or adjusted under 35 U.S.C. 154(b) by 80 days.

(21) Appl. No.: 14/150,278

(22) Filed: Jan. 8, 2014

(65) Prior Publication Data

US 2015/0192286 A1 Jul. 9, 2015

(51) Int. Cl.

| | |
|---|---|
| ***F21V 29/00*** | (2015.01) |
| ***F21V 15/01*** | (2006.01) |
| ***F21V 21/084*** | (2006.01) |
| ***F21S 8/10*** | (2006.01) |
| ***F21L 4/02*** | (2006.01) |
| ***F21L 4/06*** | (2006.01) |
| ***F21V 14/06*** | (2006.01) |

(Continued)

(52) U.S. Cl.

CPC ..... *F21V 29/2293* (2013.01); *F21L 4/027* (2013.01); *F21L 4/06* (2013.01); *F21S 48/328* (2013.01); *F21V 14/065* (2013.01); *F21V 15/011* (2013.01); *F21V 21/084* (2013.01); *F21V 29/002* (2013.01); *F21V 29/2206* (2013.01); *F21V 29/745* (2015.01); *F21V 29/83* (2015.01)

(58) Field of Classification Search

CPC ..... F21V 29/004; F21V 29/02; F21V 21/084; F21V 14/06; F21V 14/065; F21V 29/2293; F21V 29/2206; F21V 15/011; F21V 29/002; F21V 29/83; F21V 29/745; F21S 48/328; F21L 4/06; F21L 4/027

See application file for complete search history.

(56) References Cited

U.S. PATENT DOCUMENTS

| | | | | |
|---|---|---|---|---|
| 4,939,374 | A * | 7/1990 | Greutert | 250/504 R |
| 5,722,762 | A * | 3/1998 | Soll | 362/105 |
| 6,227,686 | B1 * | 5/2001 | Takahashi et al. | 362/345 |

(Continued)

FOREIGN PATENT DOCUMENTS

| | | | |
|---|---|---|---|
| FR | 2 989 447 | A1 | 10/2013 |
| WO | WO 2013/060329 | A1 * | 5/2013 |

OTHER PUBLICATIONS

Extended European Search Report for corresponding European Application No. 15000021.4 dated May 13, 2015, 8 pages.

*Primary Examiner* — Bao Q Truong

(74) *Attorney, Agent, or Firm* — Alston & Bird LLP

(57) ABSTRACT

A multi-purpose illumination device and a system and method for operating a multi-purpose illumination device are provided herein. A multi-purpose illumination device may include a lamp housing and a light source disposed within the lamp housing. The lamp housing may include a front, a back, a top, and a bottom, with the light from the light source projecting from the front of the lamp housing. The lamp housing may further define an air channel with an air inlet and an air outlet. The air inlet may be defined in the front of the lamp housing. The air outlet may be defined in the top of the lamp housing. Some embodiments may include a heat sink disposed within the lamp housing, where the air channel is at least partially defined by the heat sink. The heat sink may include at least one heat-dissipating fin disposed within the air channel.

18 Claims, 7 Drawing Sheets

(51) Int. Cl.
*F21V 29/74* (2015.01)
*F21V 29/83* (2015.01)

(56) References Cited

U.S. PATENT DOCUMENTS 7,775,689 B2 * 8/2010 Nishimura et al. ..... 362/345
8,376,574 B2 * 2/2013 Spartano et al. ..... 362/231
8,573,798 B2 11/2013 Reimann et al.
2006/0056175 A1 * 3/2006 Petzl et al. ..... 362/187
2008/0286124 A1 11/2008 Sen et al.
2010/0214766 A1 * 8/2010 Hunt ..... 362/105
2010/0214781 A1 * 8/2010 Chiu et al. ..... 362/249.06
2011/0075400 A1 * 3/2011 Lau ..... 362/105
2013/0250593 A1 * 9/2013 Popper et al. ..... 362/476
2013/0255116 A1 * 10/2013 Kaoh ..... 40/563

* cited by examiner

MULTI-PURPOSE ILLUMINATION DEVICE

FIELD

Embodiments of the present invention generally relate to systems and methods for providing illumination and, more particularly, to a multi-purpose illumination device, and a system and method for operating a multi-purpose illumination device.

BACKGROUND

Illumination devices, such as wearable headlamps or flashlights, are frequently used to provide illumination for various sporting and commercial endeavors. As an example, many sporting headlamps are provided with an elastic head band that allows hikers and climbers to wear the headlamps on their head or helmet in order to provide hands-free visibility in low-light conditions. Headlamps of this type are often used, for example, when navigating a trail at night, pitching a tent in darkness, or performing an early morning alpine ascent. These headlamps may also be adapted to provide hands-free illumination in commercial and public safety environments, such as low-light construction sites or during a fire rescue.

Illumination devices may also be used for various activities, both indoor and outdoor, to provide the proper amount of illumination for a particular implementation. However, the various uses of illumination devices may require different amounts of light, different distances at which an object is to be illuminated, and different form factors for convenient use. Some illumination devices may be configured for a specific activity such that they are ineffective or undesirable for use in other activities. Such embodiments may require multiple illumination devices for multiple activities, despite the fact that illumination is the fundamental function of each of these devices.

Additionally, illumination devices now offer functions beyond a mere on or off configuration. For example, illumination devices may have varying degrees of brightness, strobe functionality, auto-dimming functionality, etc. As the functionality becomes more complex, the operation of such illumination devices may require additional functionality not previously needed.

SUMMARY

In light of the foregoing background, example embodiments of the present invention provide an illumination device including a lamp housing and a light source disposed within the lamp housing. The lamp housing may include a front, a back, a top, and a bottom, with the light from the light source projecting from the front of the lamp housing. The lamp housing may further define an air channel with an air inlet and an air outlet. The air inlet may be defined in the front of the lamp housing. The air outlet may be defined in the top of the lamp housing. Some embodiments may include a heat sink disposed within the lamp housing, where the air channel is at least partially defined by the heat sink. The heat sink may include at least one heat-dissipating fin disposed within the air channel. The air inlet may include at least one air guide configured to direct air into the air inlet. The air inlet may define an air receiving direction in which air is received into the lamp housing, and the air outlet may define an air outlet direction from which air exits the lamp housing. The air receiving direction and the air outlet direction may be arranged at a relative angle of between about 45 degrees and about 90 degrees.

According to some embodiments, the light source may be a first light source and the illumination device may include a second light source disposed within the lamp housing and configured to project light from the front of the lamp housing. The illumination device may include a first lens positioned in front of the first light source and a second lens disposed in front of the second light source. Light may be emitted from the first light source in a substantially symmetrical pattern about a first axis and light may be emitted from the second light source in a substantially symmetrical pattern about a second axis. The first lens may be adjustable relative to the light source along the first axis and the second lens may be adjustable relative to the light source along the second axis. The first lens and the second lens may be independently adjustable. The lamp housing may include a bracket, and the bracket may be configured for mounting on both a headband and a bicycle.

Embodiments of the present invention may include an illumination device with a lamp housing, a first light source, and a second light source. The illumination device may further include a first focus adjustment to focus light emitted from the first light source and a second focus adjustment to focus light emitted from the second light source. The lamp housing may include a front, a back, a top, and a bottom. Embodiments may include a power control configured to operate the first light source and the second light source independently and in unison. The first light source may be operable in a first on-state while the second light source may be operable in a second on-state, different from the first on-state, simultaneously. Embodiments may include an air channel defined within the lamp housing, where the air channel includes an inlet and an outlet. The air inlet may be disposed in the front of the lamp housing and the air outlet may be disposed in the top of the lamp housing. The illumination device may include a heat sink in thermal communication with the first light source and the second light source, where the heat sink is disposed within the air channel.

According to some embodiments, the lamp housing may include a coupling mechanism on the back side of the lamp housing. The illumination device may include a power source located remotely from the lamp housing, where the power source may include a coupling mechanism and the power source may be connected to the lamp housing by a power cord. The lamp housing may be configured to be removably attached to the power source.

BRIEF DESCRIPTION OF THE DRAWINGS

Figure 1:
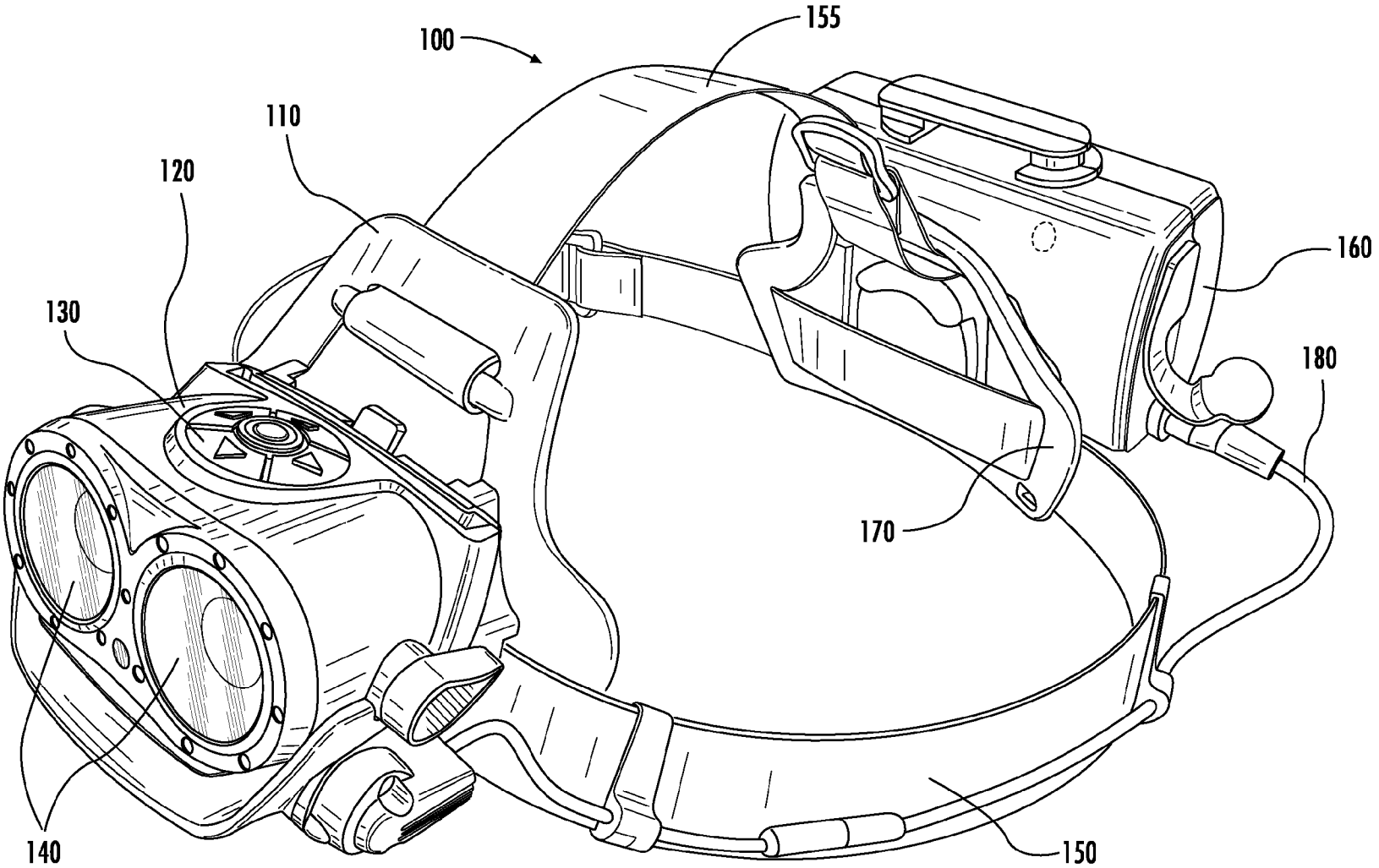
Figure 2:
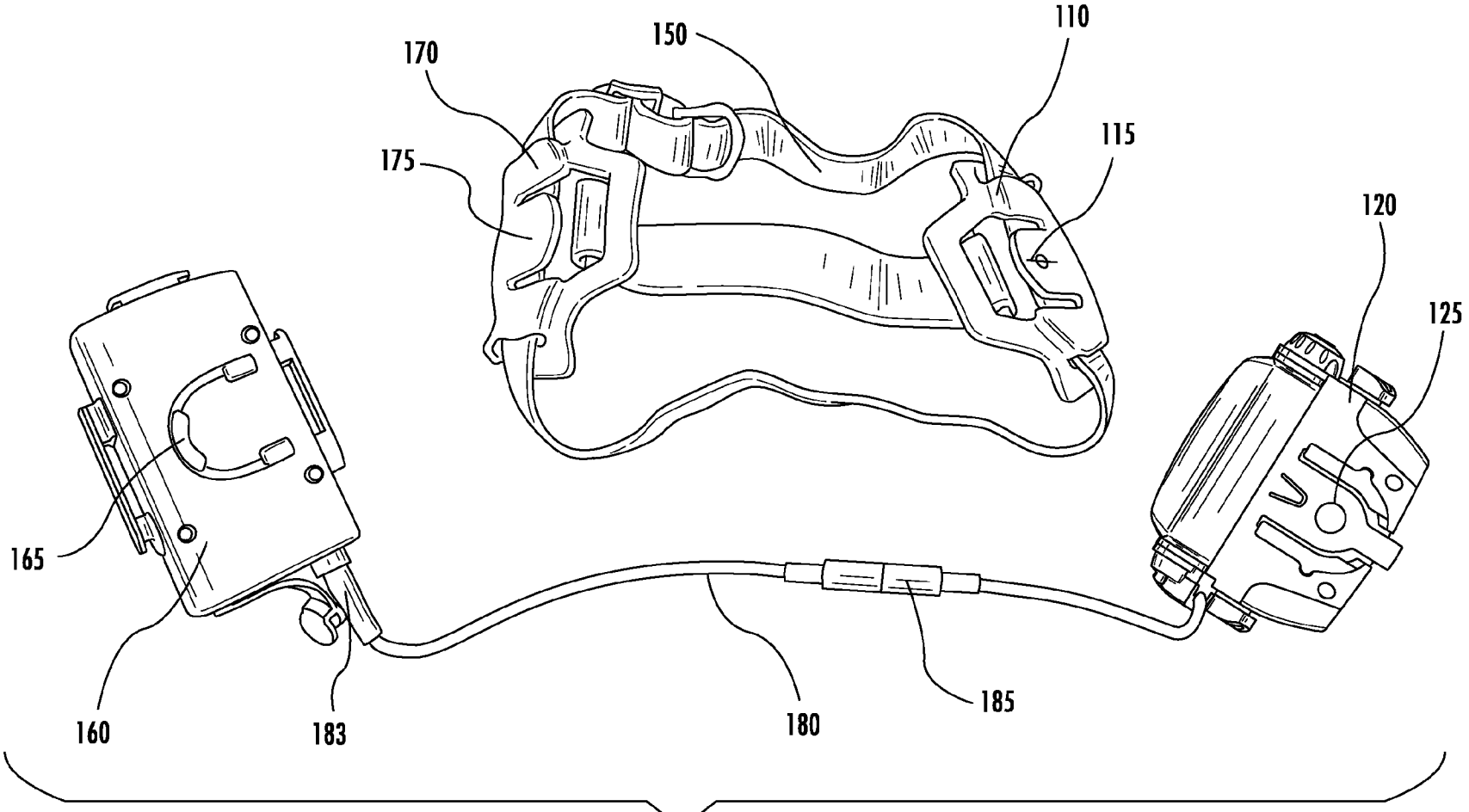
Figure 3:
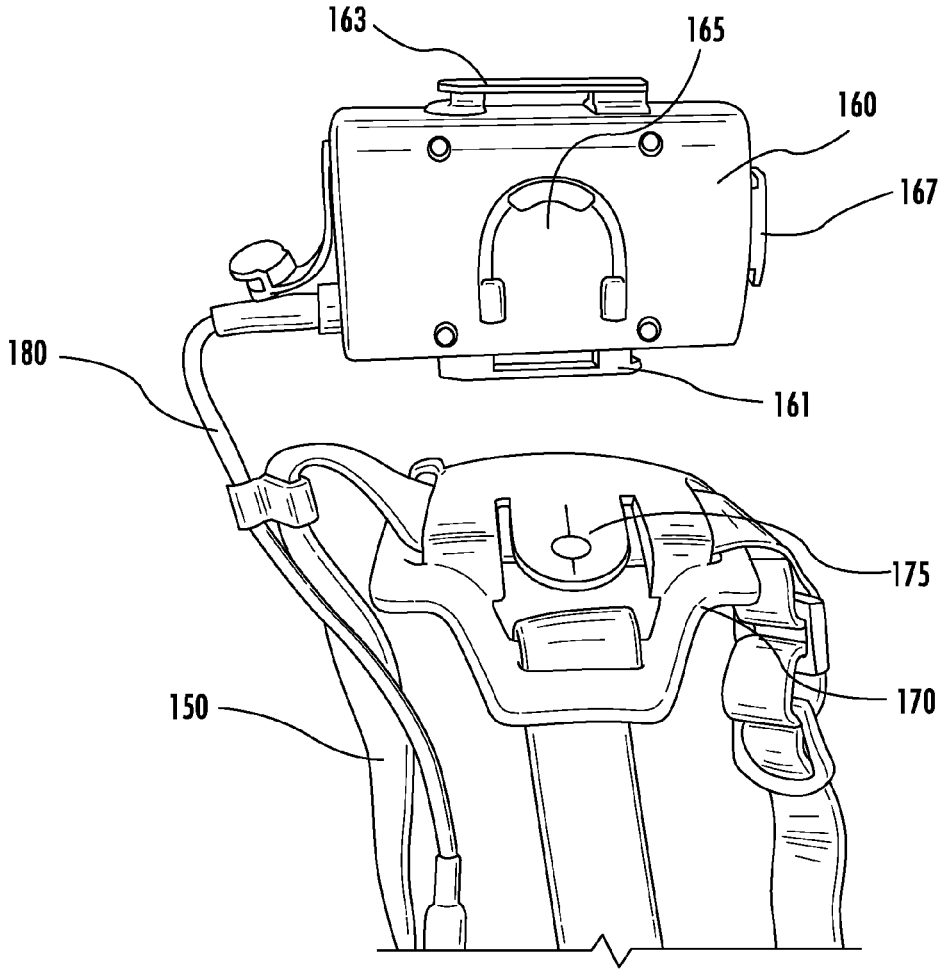
Figure 4:
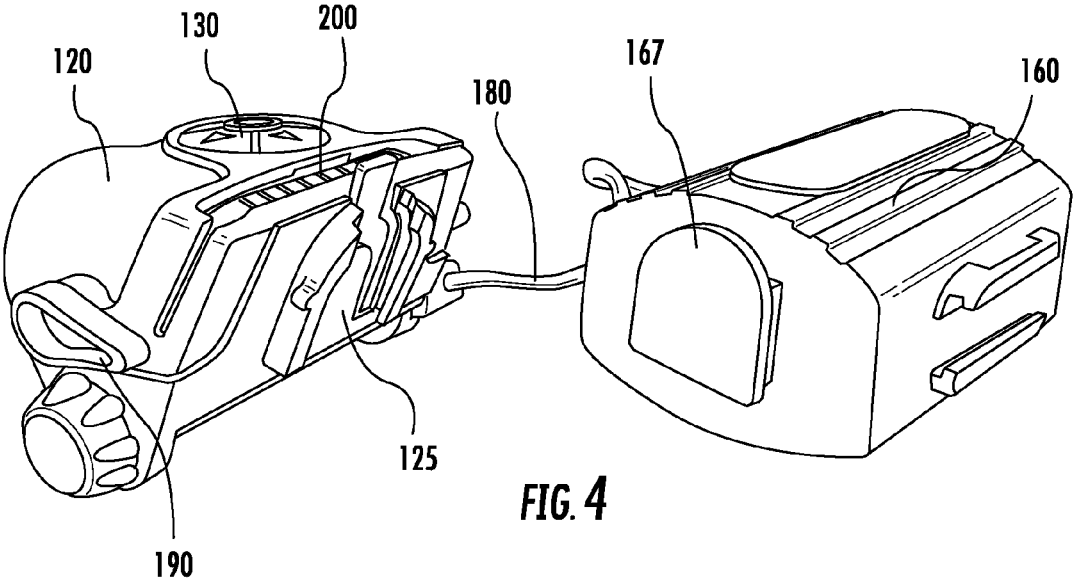
Figure 5:
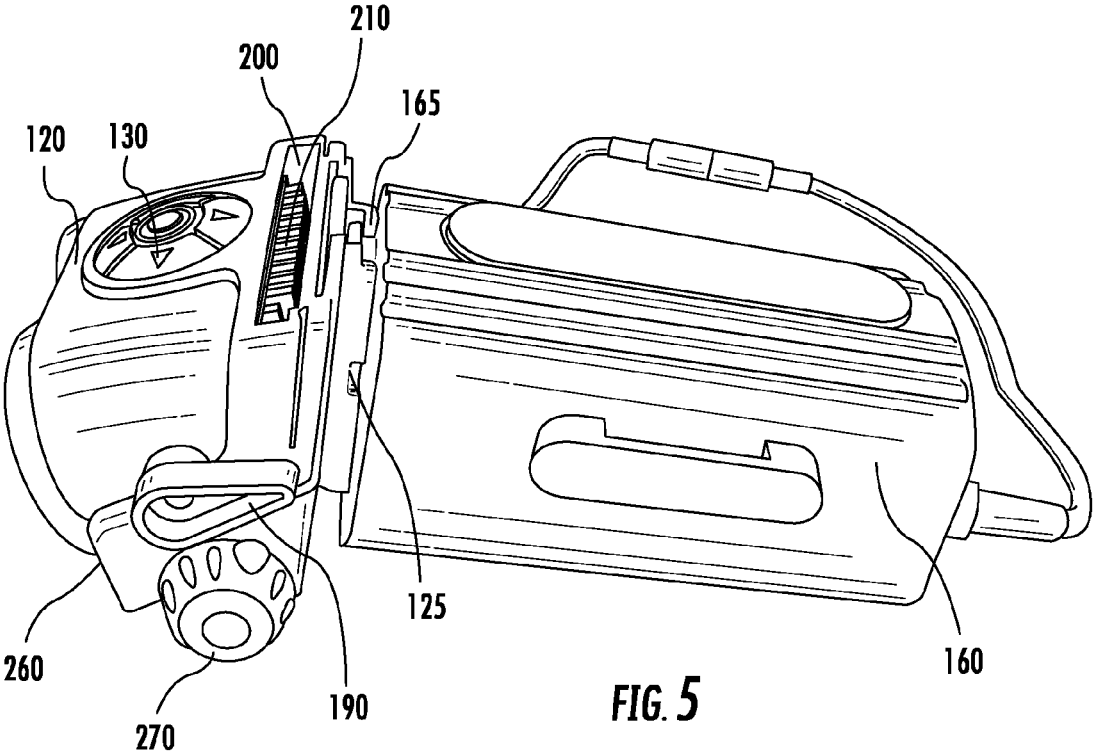
Figure 6:
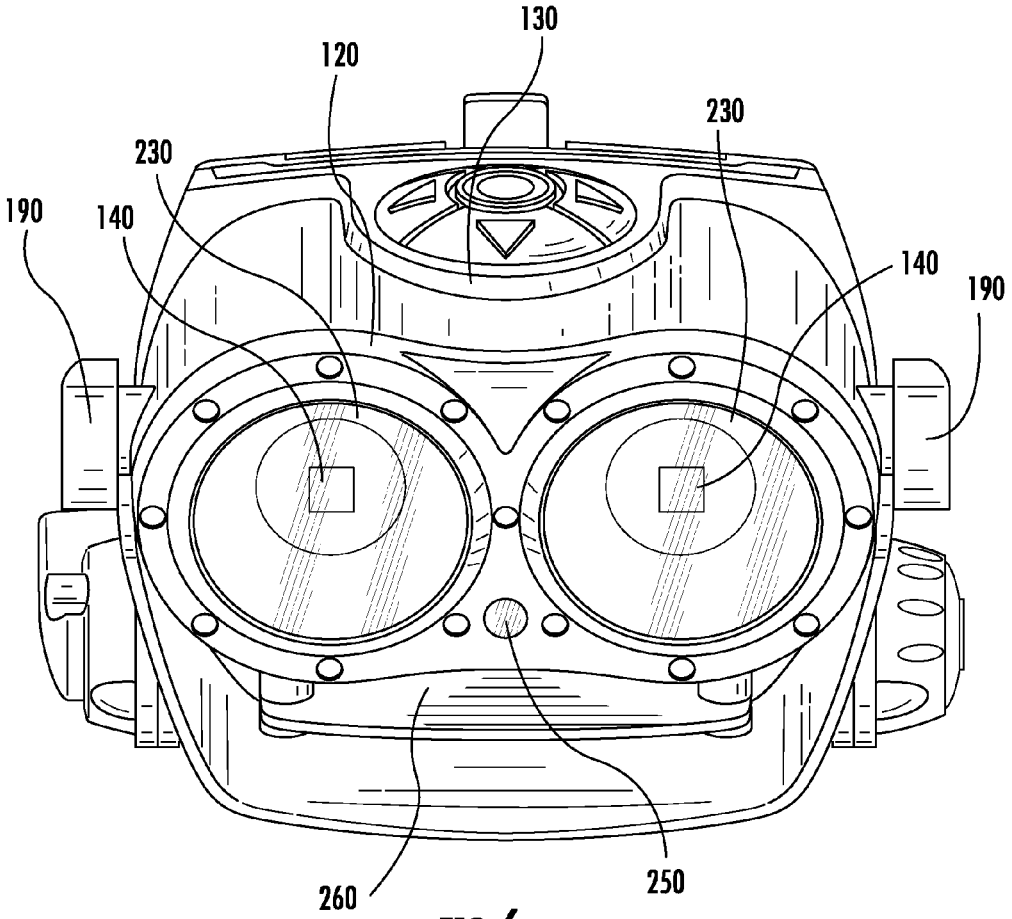
Figure 7:
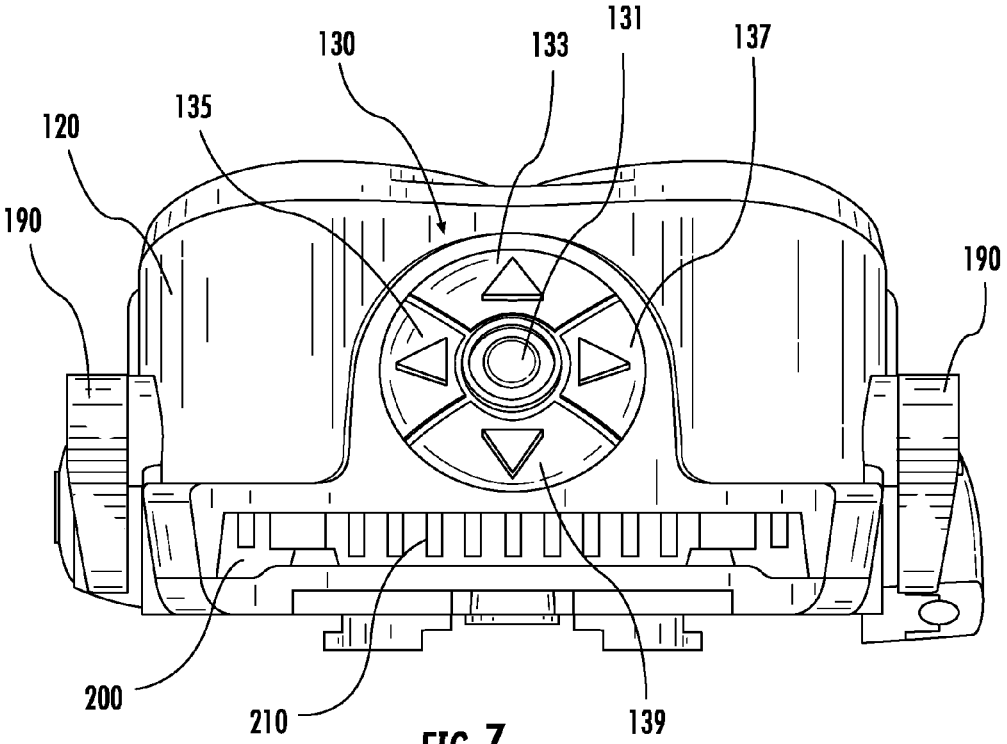
Figure 8:
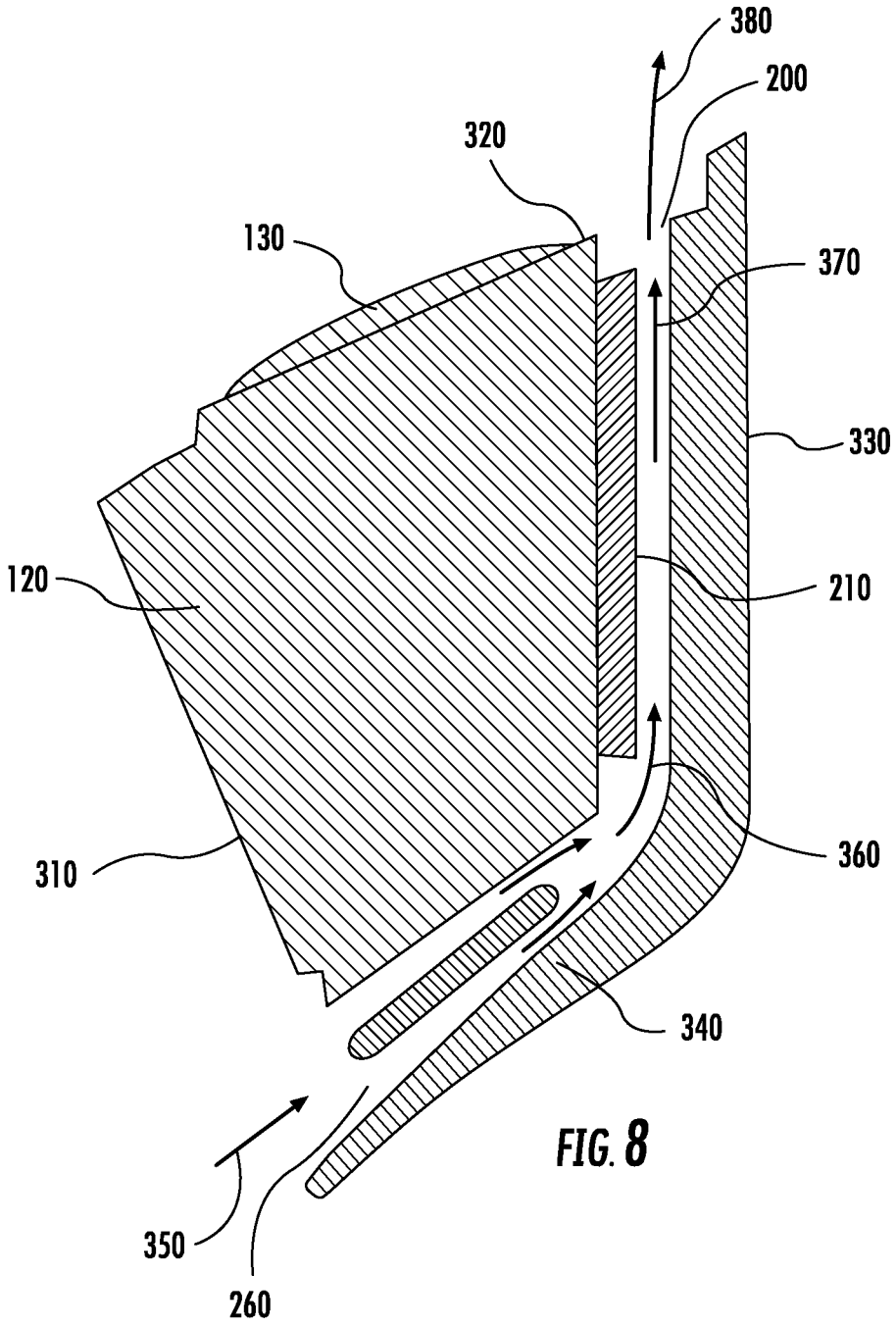

Having thus described example embodiments of the invention in general terms, reference will now be made to the accompanying drawings, which are not necessarily drawn to scale, and wherein:

FIG. 1 is an illustration of an illumination device in a headlamp configuration according to an example embodiment of the present invention;

FIG. 2 is an illustration of the illumination device of FIG. 1 removed from the headband and brackets;

FIG. 3 is an illustration of an attachment mechanism between the power source and the bracket of the headband according to an example embodiment of the present invention;

FIG. 4 is an illustration of an attachment mechanism between the power source and the lamp housing according to an example embodiment of the present invention;

FIG. 5 is an illustration of a power source coupled to a lamp housing according to an example embodiment of the present invention;

FIG. 6 is an illustration of the front side of a lamp housing according to an example embodiment of the present invention;

FIG. 7 is an illustration of the top side of a lamp housing according to an example embodiment of the present invention; and FIG. 8 is a cross-section of the lamp housing of FIGS. 6 and 7 taken between the two light sources according to an example embodiment of the present invention.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Various embodiments of the present invention are generally directed to a multi-purpose illumination device that can be used for a variety of activities in a number of different configurations. While embodiments are generally described herein as useable for a wearable headlamp attached to a headband, useable as a hand-held flashlight, and usable to mount to a stationary or mobile platform (e.g., a bicycle), it is appreciated that embodiments may be used in numerous other configurations for other purposes and activities. Further, various components of the disclosed embodiments may be sold individually or in combination with other components, such as an illumination device sold as a wearable headlamp including a headband, a lamp housing, and a power source, or an illumination device sold as a bicycle headlamp which may include a lamp housing, a power source, and a mounting bracket to mount the lamp housing and/or the power source to a bicycle. Illumination devices according to example embodiments may optionally be configured to be mounted to various mobile and non-mobile platforms, such as baby strollers (e.g., jogging strollers), all-terrain vehicles, golf carts, tents or tent posts, under a vehicle hood during maintenance work, cameras, worksites, etc. Various other embodiments of example illumination devices may be sold in various configurations according to the intended application for the illumination device.

Referring now to the example of FIG. 1, embodiments of the present invention may include a wearable headlamp 100 which may generally include a bracket 110 with an attached lamp housing 120. As will be described further below, the lamp housing 120 may be removable from the bracket 110. The bracket 110 may be attached to a headband 150 which may include a headband which is configured to be worn about the circumference of a wearer's head, while some embodiments may include a top strap 155 which may help position the headband 150 on a wearer's head.

While some embodiments may include a power source disposed within the lamp housing 120, the illustrated embodiment of FIG. 1 includes a separate power source 160 which may be connected to the lamp housing 120 via a power cord 180. The wire 180 may conduct power from the power source 160 to the lamp housing 120 to provide power to the light source(s) 140 within the lamp housing 120. The power source 160 may be a battery or capacitor configured to provide portable power to the lamp housing 120. The power source 160 may be directly attached to the headband 150 or, as shown in the illustrated embodiment, the power source 160 may be removably attached to a back bracket 170 while the back bracket 170 is attached to the headband 150 and the top strap 155. The lamp housing 120 may include a power control 130 which may be a single-function button or switch, or a multi-function button as illustrated in FIG. 1 and described further below.

The illustrated lamp housing 120 includes a plurality of sides, such as a first side, a second side, a third side, and a fourth side, where the first and second sides are spaced apart and substantially parallel to one another, and where the third and fourth sides are similarly spaced apart and substantially parallel to one another. Further, the third and fourth sides are substantially perpendicular to the first and second sides. For purposes of explanation, but not of limitation, the first and second sides will be described herein as front and back sides, with the light sources emanating from the front side and the back side being mounted to the headband bracket 110 as illustrated in FIG. 1. The third and fourth sides will be described herein as the top and bottom sides, with the top side including the power control 130 and the bottom side forming part of the cooling air channel, as will be described further below.

FIG. 2 illustrates the lamp housing 120 and power source 160 as separated from their respective brackets 110, 170. The illustrated power source 160 includes a channel 165 into which a corresponding tab 175 of the back bracket 170 is received. The tab 175 may releasably engage the channel 165 and be held in place by detents within the tab 175 and/or channel 165 to provide a secure coupling between the power source 160 and the back bracket 170. Similarly, the lamp housing 120 may include a channel 125 into which a tab 115 from the bracket 110 may be received. The tab 115 and/or the channel 125 may include a retention mechanism such as a detent or locking tab to secure the coupling between the lamp housing 120 and the bracket 110. As shown, the power source 160 and the lamp housing 125 are connected by power cord 180. The power cord 180 may include a connector 185 that enables the lamp housing 120 to be separated from the power source 160. This connector 185 may further enable the lamp housing 120 to be plugged into an alternate power source, such as another battery or a hard-wired power source such as a transformer plugged into a wall socket.

The power cord 180 may be connected to the power source at a power source connector 183. The power source connector 183 of the power cord 180 may be received into a power socket of the power source 160. The power socket may be configured to supply power to a lamp housing (via the power cord 180), but the power socket may also be configured to receive power, for example, from a hardwired power source, to charge the power source 160. The power socket may be a conventional co-axial power supply form or the power socket may be a universal serial bus (USB) style connector, such as a standard USB, mini-USB, or micro-USB, through which the power source 160 may send or receive power. Optionally, the power source 160 may include multiple sockets, such as a USB-type socket and a co-axial type socket to enable the power source 160 to send or receive power through either socket. The power source 160 may further be configured with a status indicator that enables a user to determine how much charge remains in the power source 160. The status indicator may be one or more lights (e.g., light emitting diodes (LEDs)), an LCD indicator, or a numerical indicator to provide an indication of charge level to a user. In order to conserve power, the status indicator may only provide an indication of the charge level in response to a user input, such as the press of a button on the power source 160. The status indicator may provide a charge level while the light source is on, while it is off, while the power source is charging, and/or while the power source is nearing a critical (e.g., low) charge state.

FIG. 3 illustrates an enlarged view of the power source 160 and back bracket 170 including the tab 175 and channel 165 for securely coupling the power source and back bracket together. The power source may further include connectors 161, 163, configured to engage and attach to other power sources. For example, connector 161 may be a male connector while connector 163 may be a female connector. In this manner, multiple power sources may be connected to one another to provide power for multiple lamp housings 120, or to provide multiple power source options for a single lamp housing, thereby extending the useful life of the illumination device. The illustrated embodiment further depicts a tab 167 disposed on an end of the power source, as will be detailed further below.

FIG. 4 illustrates an enlarged view of the power source 160 and the lamp housing 120, illustrating an example embodiment in which the lamp housing 120 and power source 160 can be used exclusive of the headband 150. As illumination devices may be used in a wide variety of settings for a wide variety of applications, the ability of a single illumination device to be used in multiple settings and applications may increase the utility of an illumination device. As shown in FIG. 4, the power source 160 may include a tab 167 that is configured to be received in the channel 125 of the lamp housing 120. The channel 125 and tab 167 may include retention features such as detents, locking tabs, or other mechanisms to securely couple the lamp housing 120 to the power source 160 when the tab 167 is received within the channel 125. FIG. 5 illustrates the lamp housing 120 coupled to the power source 160 with the tab 167 received within the channel 125. The configuration of the illumination device illustrated in FIG. 5 may be useful as a hand-held flashlight enabling the user to comfortably hold the illumination device, including the power source 160 and the lamp housing 120, with one hand and to guide the light emitted from the lamp housing in any chosen direction.

The above described and illustrated embodiments describe an illumination device useful as a wearable headlamp and as a flashlight, but it is appreciated that the illumination device of the illustrated embodiments may be used in a wide variety of applications beyond those illustrated. For example, a bicycle may include a bracket that may be mounted, for example to the handlebars, with a tab that can be securely received in the channel 125 of the lamp housing 120. Such an example would allow a user to mount the lamp housing 120 on the bicycle to be used as a vehicle headlamp. The bicycle may further be configured with a bracket onto which the power source may be mounted in a position to not obstruct the bicycle rider. The power cord 180 may be a long or short power cord depending upon the application, and the power cord may be interchangeable and/or coiled to provide additional length when needed. Illumination devices of example embodiments may be used in countless applications and embodiments may include brackets with universal mounts, such as adhesive backed mounts, expandable/clamp-type mounts, etc., which allow a user to position an illumination device in any manner they may need. Embodiments may be used as a work light to illuminate the engine bay of a vehicle, a camp light which may be mounted to a tree, tent, or other apparatus to illuminate a campsite, etc.

While the above described embodiments include features that enhance the variety of applications in which such an illumination device may be used, further features of example embodiments may enhance the usefulness of the illumination device in any or all of these various applications. For example, as illustrated in FIG. 5, the lamp housing 120 may be provided with a focus adjustment 190, which in the illustrated embodiment is a lever. The focus adjustment 190 may be configured to adjust the position of a lens of the lamp housing (illustrated as element 230 in FIG. 6) relative to the light source (disposed within the housing, visible as element 140 of FIG. 6). The lens 230 may include a convex curvature configured to focus the light emitted from the light source 140. Adjusting the lens 230 relative to the light source 140, along an axis about which the light source 140 emits a substantially symmetrical pattern of light, allows the focal length, or distance at which the light is focused, to be adjusted. Further, while the illustrated embodiment includes a lens with a convex curvature to focus the light, embodiments may include a lens with a parabolic-type reflector disposed behind the lens, which can be adjusted relative to the light source 140 to change the focal length.

FIG. 5 illustrates one side of the lamp housing 120, and one focus adjustment. While some embodiments may include a single light source or multiple light sources configured to act in concert as a single light source, other embodiments may include two or more distinct light sources, such as the two distinct light sources 140 and lenses 230 of the front-view of FIG. 6. In such an embodiment, each of the two lenses 230 may include a separate focus adjustment 190 allowing the two light sources 140 to have different effective focal lengths. This individual adjustment may allow a user to focus a relatively fine beam of light to brightly illuminate a particular object of interest, while the second light source is adjusted to provide a relatively wide beam of light to illuminate the area surrounding the object. The focus adjustments 190 may be infinitely adjustable between a maximum lens extension (where the lens 230 is furthest from the light source 140) and a minimum lens extension (where the lens 230 is closest to the light source 140). This infinite adjustability may enable a user to customize the focus of each light source to best suit the illumination characteristics that the user desires.

Referring again to FIG. 6, the lamp housing 120 may include a photosensor 250 disposed therein. The photosensor 250 may be implemented to variably adjust the brightness of the one or more light sources in response to the light detected at the photosensor 250. For example, if the photosensor 250 detects a high amount of light, the lamp housing 120 may be receiving reflected light from the light sources 230 or the photosensor may be detecting high amounts of ambient light. In either case, the light sources 230 may be adjusted to reduce the brightness of the light. Alternatively, in an embodiment in which the illumination device is used as a bicycle headlamp, the detection of light at the photosensor 250 may result in the light sources increasing in brightness. This may be done to enable a bicycle rider to be more visible during the day (e.g., when the photosensor 250 is detecting high amounts of ambient light) or be visible to oncoming traffic (e.g., when the photosensor 250 is detecting the light of oncoming traffic).

FIG. 6 further illustrates an air inlet 260 configured to receive cooling air. The light sources 230 may generate significant heat. Heat generated by a light source, if not properly dissipated, can result in premature failure of the light source and/or a degradation in performance of the light source 140. As such, it may be important to dissipate heat efficiently and effectively to maintain a good operating environment for the light sources 140. The air inlet 260 of FIG. 6, defined within the front of the lamp housing 120, may be in communication with an air cooling channel. The air cooling channel may be defined within the lamp housing 120 to receive air through the air inlet 260 and dispel air from an air outlet. FIG. 7 illustrates a view of the top side of the lamp housing 120 including the air outlet 200. As shown in FIG. 7, a heat sink 210 may be disposed within the air channel. The heat sink 210 may be connected to the light source(s) though thermally conductive means, such as a material with high thermal conductivity (e.g., aluminum) and/or the use of adhesives with relatively high thermally conductivity. Such a configuration allows the heat generated by the light source(s) to be thermally conducted to the heat sink 210 where the heat is dissipated by air flow across the heat sink 210.

According to the illustrated embodiment, the air inlet 260 is disposed on the front side of the lamp housing 120 while the air outlet is disposed in the top side of the lamp housing 120. This configuration allows the air channel to guide the air through a bend within the lamp housing. The bend within the lamp housing may be radiused to avoid a sharp turn which would hamper air flow and reduce the cooling efficiency. Further, turning the air flow is beneficial for a variety of uses of the illumination device. In an example embodiment in which the illumination device is used as a wearable headlamp, air may enter the lamp housing 120 through the air inlet 260, but an air outlet in the back side of the lamp housing 120 would direct warm air into a user's forehead, which may be unpleasant. Further, if the wearer is, for example, running or riding a bicycle, the air flow through the air inlet 260 may be substantial, and forcing the air to turn and exit through the top side of the lamp housing 120 may be more conducive to comfort.

Another advantage of the forward-facing air inlet 260 and the air outlet on the top side of the lamp housing is the positioning of the heat sink 210. With the light sources 230 facing forward, the greatest amount of heat is generated in front of and behind the light sources. As cooling the light sources from the front side with a heat sink is impractical (as the light would be blocked), it is desirable to thermally couple (using high thermal conductivity materials/adhesive) the back side of the light source to a heat sink 210. Thus, allowing air to travel in a plane substantially co-planar to the heat sink 210 and the back of the light sources 230 improves the amount of heat transfer to the air passing through the cooling air channel.

While the illustrated embodiment is described with an air inlet 260 and air outlet 210, when the lamp housing 120 is stationary and air is not being forced through the air inlet 260 (as when the lamp housing is attached to moving bicycle), air may move through the air channel by virtue of the heated air (air in the air channel of the heat sink 210) rising. This provides a natural convection of air through the air inlet 260 and across the heat sink 210 as the heated air exits the air outlet 200. This is another advantage of locating the air outlet 200 on the top of the lamp housing 120.

FIG. 8 illustrates a cross-section of the lamp housing 120 taken along a centerline of the lamp housing between the light sources. The illustrated cross section depicts the first side 310, which in the illustrated embodiment is the front side, a second side 330, which in the illustrated embodiment is the back side, a third side 320, which in the illustrated embodiment is a top side, and a fourth side 340, which in the illustrated embodiment is a bottom side. Relatively cool air (i.e., ambient air) is received through air inlet 260 of the first side 310 of the housing 120 and bends at 360 to flow in a path substantially parallel to the heat sink 210. The air is heated as it makes contact with the heat sink at 370, and exits the cooling channel at 380 through air outlet 200.

Referring again to FIG. 7, the illumination device of example embodiments may include a user interface to turn the light sources to an on-state and/or to cycle the light sources between operational states (e.g., a bright on-state, a dim on-state, a strobe on-state, etc.). The power control 130 may be a multi-functional user interface providing a user with multiple input options. As shown, the power button includes a center button 131, a front button 133, a left button 135, a right button 137, and a back button 139. The power control 130 may be used to enable various operating modes of the light sources and to operate the light sources independently.

In an example embodiment, the center button 131 may be used to transition the light source(s) to an on-state. The on-state may be a bright on-state and, according to the illustrated embodiment, both light sources may be operated together with the center button 131. If the center button is pressed a second time, within a predetermined amount of time of the initial press (e.g., 2 seconds), the light sources may be transitioned to a second on-state, such as a dim on-state. If the center button is pressed a third time, within a predetermined amount of time of the second time (e.g., 2 seconds), the light sources may be transitioned to a third on-state, which may be a strobe on-state, for example. A fourth press of the center button may transition the light sources to an off-state. Further, a press of the center button while the light sources are in an on-state, but after a predetermined amount of time has elapsed, regardless of the on-state, the light sources may be transitioned to an off-state.

The left button 135 and the right button 137 may be configured to operate in the same manner as the center button 131; however, each of the left button 135 and the right button 137 may be configured to operate only a respective one of the light sources 230. In this manner, a user may use only one light source 140 to conserve battery power, or the user may operate both light sources in different operating modes, such as when a narrow focused beam of one light source is desired to operate in a high-brightness on-state while a more broadly focused beam of a second light source is desired to operate in a lower-brightness on-state.

The front button 133 and the rear button 139 may be implemented to cycle the light sources between various other operating modes. For example, the front button 133 may be configured to toggle both light sources between a bright on-state, a dim on-state, and an off-state, while the rear button 139 may be configured to toggle both light sources between an off-state and a dim on-state. Further, a sustained pressing of the front button 133 may engage a "boost" mode in which the light sources 130 are illuminated at their brightest level. The boost on-state may be temporary, for example, ten seconds, in order to prolong battery life. In some example embodiments, one or more of the buttons may be user-programmable such that a user may customize the light source operational modes available through a press of the button.

Further, one or more additional buttons or switches may be available to implement additional levels of functionality. Such a switch may be used to switch between operational modes that use feedback from the photosensor 250. Example embodiments of such a switch may include a rotational dial and/or a push-button, and user feedback as to the operational mode that the illumination device is in may be provided by, for example, a flash pattern of one or more of the light sources. A first operational mode may be indicated by a single flash of the light source, while a second operational mode may be indicated by two sequential flashes of the light source, etc. One operational mode may include where light detected at the photosensor causes the light sources to dim. This operational mode may be a "reading" mode where light detected by the photosensor is determined to be reflected light, which may be undesirable in a reading mode. Another operational mode may include a vehicle headlamp mode, in which light received at the photosensor may cause the illumination device to increase the brightness of the light sources, determining that the photosensor is detecting the light of oncoming traffic.

As will be appreciated, the buttons 131, 133, 135, 137, 139, and 270 may be used in any conventional manner to implement various operational functions of the illumination device as described herein. Further, the multiplexing of the user inputs, such as a button having a first function in a first operational mode and a second function in a second operational mode, may enhance the utility of the illumination device of example embodiments.

Example embodiments of an illumination device of the present invention may further be configured with a mechanism to allow the lamp housing 120 to be tilted relative to the bracket to which the lamp housing is attached. For example, as shown in FIG. 5, the front of the lamp housing, including the light source(s) and focus adjustment mechanisms 290 may be configured to pivot relative to a back of the lamp housing 120 that includes the surface on which the channel 125 is affixed. The front of the lamp housing 120 may be configured to pivot about an axis, such as an axis through the center of locking button 270. The locking button 270 may be arranged to enable and disable the front of the lamp housing 120 to pivot. For example, in response to locking button 270 being depressed, the front of the lamp housing 120 may pivot relative to a back of the lamp housing. In response to the locking button 270 being released, the front of the lamp housing 120 may be in a fixed position relative to the back of the lamp housing. Such adjustability may allow the lamp housing 120 to be mounted to a bracket, such as on a headband or on a bicycle, and adjusted to direct light from the light sources 130 in the desired direction in the desired elevation.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An illumination device comprising:

a lamp housing comprising a front, a back, a top and a bottom;

a first light source disposed within the lamp housing configured to project light from the front of the lamp housing through a first lens;

a second light source disposed within the lamp housing configured to project light from the front of the lamp housing through a second lens;

a first focus adjustment mechanism disposed proximate the first light source and configured to adjust a focal length between the first light source and the first lens;

a second focus adjustment mechanism disposed proximate to the second light source configured to adjust a focal length between the second light source and the second lens, independent of the focal length between the first light source and the first lens;

wherein the lamp housing defines an air channel comprising an air inlet and an air outlet, wherein the air inlet is defined in the front of the lamp housing; and a power control comprising a first switch operable to control the first light source and the second light source in unison, a second switch operable to control the first light source independently of the second light source, and a third switch operable to control the second light source independently of the first light source.

2. The illumination device of claim 1, wherein the air outlet is defined in the top of the lamp housing.

3. The illumination device of claim 2, further comprising a heat sink within the lamp housing, wherein the air channel is at least partially defined by the heat sink.

4. The illumination device of claim 3, wherein the heat sink comprises at least one heat-dissipating fin disposed within the air channel.

5. The illumination device of claim 1, wherein the air inlet comprises at least one air guide configured to direct air into the air inlet.

6. The illumination device of claim 1, wherein the air inlet defines an air receiving direction in which air is received into the lamp housing and the air outlet defines an air outlet direction from which air exits the lamp housing, wherein the air receiving direction and the air outlet direction are arranged at a relative angle of between about 45 degrees and about 90 degrees.

7. The illumination device of claim 1, wherein the light is emitted from the first light source in a substantially symmetrical pattern about a first axis, and wherein light is emitted from the second light source in a substantially symmetrical pattern about a second axis, wherein the first axis and the second axis are parallel and offset from one another.

8. The illumination device of claim 1, wherein the lamp housing comprises a bracket, and wherein the bracket is configured for mounting on both a headband and a bicycle.

9. An illumination device comprising:

a lamp housing comprising a front, a back, a top, and a bottom;

a first light source disposed within the lamp housing;

a second light source disposed within the lamp housing;

a first focus adjustment mechanism to focus light emitted from the first light source;

a second focus adjustment mechanism to focus light emitted from the second light source, independent of the first light source; and a power control comprising a first switch operable to control the first light source and the second light source in unison, a second switch operable to control the first light source independently of the second light source, and a third switch operable to control the second light source independently of the first light source.

10. The illumination device of claim 9, wherein the first light source may be operable in a first on-state while the second light source may be operable in a second on-state, different from the first on-state, simultaneously.

11. The illumination device of claim 9, further comprising an air channel defined within the lamp housing, wherein the air channel comprises an air inlet and an air outlet.

12. The illumination device of claim 11, wherein the air inlet is disposed in the front of the lamp housing, and wherein the air outlet is disposed in the top of the lamp housing.

13. The illumination device of claim 12, further comprising a heat sink in thermal communication with the first light source and the second light source, wherein the heat sink is disposed within the air channel.

14. The illumination device of claim 9, wherein the lamp housing comprises a coupling mechanism on the back side of the lamp housing.

15. The illumination device of claim 14, further comprising a power source located remotely from the lamp housing, wherein the power source comprises a coupling mechanism and wherein the power source is connected to the lamp housing by a power cord.

16. The illumination device of claim 15, wherein the lamp housing is configured to be removably attached to the power source.

17. The illumination device of claim 1, further comprising a photosensor disposed in the front side of the lamp housing, wherein the brightness of at least one of the first light source or the second light source is adjusted in response to an amount of light detected at the photosensor.

18. The illumination device of claim 1, wherein the first focus adjustment mechanism is disposed on a first side of the lamp housing and the second focus adjustment mechanism is disposed on a second side of the lamp housing, opposite the first side.

* * * * *